United States Patent [19]

Karp

[11] 4,237,402

[45] Dec. 2, 1980

[54] SLOW-WAVE CIRCUIT FOR TRAVELING-WAVE TUBES

[75] Inventor: Arthur Karp, Palo Alto, Calif.

[73] Assignee: Varian Associates, Inc., Palo Alto, Calif.

[21] Appl. No.: 23,923

[22] Filed: Mar. 26, 1979

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 2,827,589 | 3/1958 | Hines | 315/3.5 |
| 2,908,845 | 10/1959 | Pierce | 315/39.3 X |
| 3,208,015 | 9/1965 | Pasty | 315/3.5 X |
| 3,233,139 | 2/1966 | Chodorow | 315/3.5 |
| 3,289,031 | 11/1966 | Hiramatsu et al. | 315/39.3 X |

FOREIGN PATENT DOCUMENTS

| | | | |
|---|---|---|---|
| 1130936 | 12/1958 | Fed. Rep. of Germany | 315/3.5 |
| 1099092 | 2/1959 | Fed. Rep. of Germany | 315/3.5 |
| 1298203 | 6/1969 | Fed. Rep. of Germany | 315/3.5 |
| 44-14487 | 10/1965 | Japan | 315/3.5 |

*Primary Examiner*—Saxfield Chatmon, Jr.
*Attorney, Agent, or Firm*—Stanley Z. Cole; Peter J. Sgarbossa

[57] ABSTRACT

In a travelling-wave tube for very high frequencies the slow-wave circuit is formed of four metal combs having teeth pointed toward the electron beam. The combs are arranged in two pairs. The teeth of the two combs in each pair extend inward from opposite sides of the beam and are axially aligned to form the electrical equivalent of a half-wave bar or ladder structure. They may or may not be joined at the tips because those are low-current points. The teeth of one pair are at right angles to those of the other pair and are displaced axially to interleave with them. Each comb is preferably made from a single piece of copper to provide better dimensional precision, low circuit loss, mechanical durability and high thermal capability.

13 Claims, 17 Drawing Figures

SLOW-WAVE CIRCUIT FOR TRAVELING-WAVE TUBES

FIELD OF THE INVENTION

The invention pertains to slow-wave circuits as used in traveling-wave tubes (TWTs) particularly for very high frequencies such as millimeter waves.

PRIOR ART

A number of basic types of slow-wave circuits have been used in TWTs. At low powers and relatively low frequencies the conducting helix (and many a variation thereof) is widely used. At high power levels, coupled-cavity circuits are common. For millimeter waves, the requirements on the slow-wave circuit become severe. The structure is so small that fabrication is a major problem. The problems of electrical loss and heat dissipation are also severe. A useful circuit has been a comb-like structure with a row of parallel "quarter-wave" vane teeth. If the electron beam passes over the ends of the teeth, the coupling between the beam and the circuit wave is quite poor. If, as in other prior-art, the beam passes through holes or slits near the ends of the vanes, improved coupling results but the cutting of such "beam tunnels" is difficult and costly. Also, these asymmetrically located and relatively large tunnels may not provide good effective coupling due to the variation in RF field strength from one side to the other.

Such defects associated with single combs are alleviated in a structure having vanes or their electrical equivalents extending across the beam from opposing ground-planes, with apertures therein for passing the beam through, the vanes forming "half-wave" elements. Both types of parallel-vane structure are limited as to the nature of the fundamental dispersion (backward vs. forward wave) obtainable and as to the accompanying "cold" bandwidth.

The dispersion characteristic can be radically altered, good beam-wave coupling obtained, and a freer choice of bandwidths made available by using two sets of vanes interleaved at right angles.

One variation of this interleaved structure is known as the "Jungle Gym" circuit. The electrical equivalent of each vane is formed by a pair of parallel conducting rods extending across a hollow conducting tube, with the beam going between the two rods of a pair. Alternate pairs of rods are rotated 90 degrees. The half-wave vane structure and the "Jungle Gym" circuit have been fabricated by brazing the individual vanes or rods to a surrounding metallic envelope which is at rf ground potential.

Another electrical equivalent to the above is a coupled-cavity circuit in which each conducting end wall of a cavity has two parallel coupling slots, the slots being rotated 90 degrees in successive walls. In a variation of this coupled-cavity circuit the slots are enlarged to pie-shaped sectors of the cavity end wall and each "vane" between them is formed by a pair of pie-shaped sectors extending from opposite side walls of the cavity but not quite joining each other.

When such prior-art structures are built to operate at very high frequencies such as those of millimeter waves, four principal very severe problems are encountered. First, the machining of the parts, and the assembly by brazing or bonding or the stacking and bonding of numerous thin laminations, become intolerably difficult. Second, the numerous brazed or bonded joints occur at high-current points so that high electrical circuit loss results, especially when brazing with materials of inherent low conductivity; the thermomechanical properties are also degraded. Third, nonuniformities in the flow of braze material or in the quality of bonded joints are capable of perturbing electrical parameters sufficiently to impair TWT performance. Fourth, the inevitable imprecisions in the axial dimensions of the individual parts or layers to be stacked act cumulatively in causing errors in the circuit periodicity sufficient to impair the beam-wave synchronism necessary to TWT performance, especially at millimeter wavelengths where the circuit must be several dozen cells long and the beam perveance is low. In the last two instances, the defects are not apparent until after the costly assembly operation is completed.

SUMMARY OF THE INVENTION

An object of the invention is to provide a TWT capable of efficiently amplifying high-power signals at very high frequencies.

A further object is to provide a slow-wave circuit for millimeter waves which is easy to fabricate.

A further object is to provide a mechanically robust slow-wave circuit having high electrical and thermal conductivity.

A further object is to provide a slow-wave structure for a TWT which is easily and accurately assembled, especially with regard to a precisely regular periodicity.

These objectives are achieved by making the slow-wave circuit of four combs, each preferably machined from an integral piece of high-conductivity metal. The combs are arranged in two orthogonal pairs, the combs of each pair being on opposite sides of the electron passageway with their teeth pointed at the passageway and aligned in axial spacing with the teeth of the opposite comb of the pair. The teeth may have recessed tips to more completely surround the beam passageway, and then may simply touch the tips of the opposite comb or be joined as by brazing. The teeth are mirror-image symmetrical so there is no electric current across the joint. The teeth of one pair are disposed at a large angle such as 90 degrees to the teeth of the other pair and are displaced axially by one-half the single-comb pitch to align with the spaces between the teeth of the other pair. In a much preferred embodiment, the axial thickness of the teeth is less than that of the spaces between and the teeth of the two pairs are interleaved.

DESCRIPTION OF THE PREFERRED EMBODIMENTS

Figure 1:
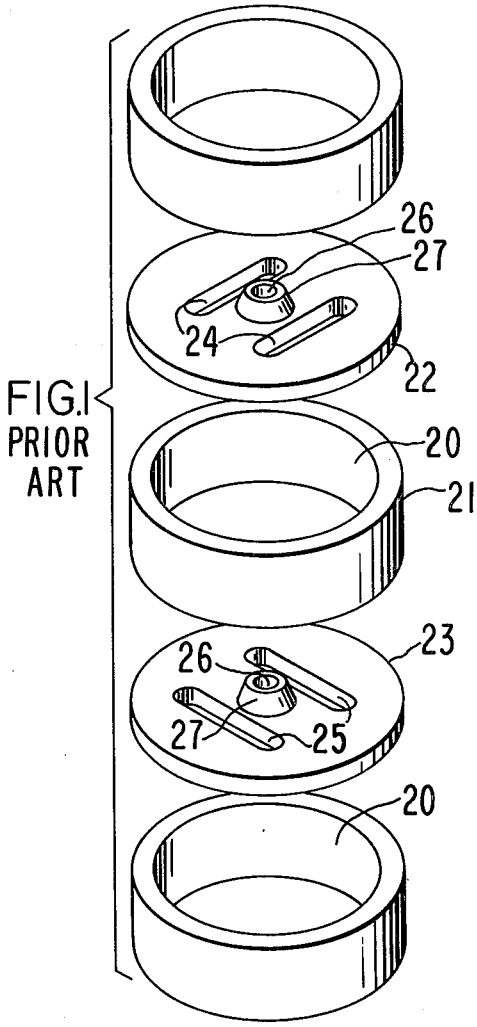
FIG.1 PRIOR ART
FIG. 1 is an exploded perspective schematic view of a prior-art coupled-cavity slow-wave circuit.

FIG. 1 is an exploded perspective view of a prior-art coupled-cavity slow-wave circuit which is electrically nearly equivalent to the circuit of the present invention. Each circuit element is a resonant cavity 20 formed by an outer ring 21 whose ends are closed by a pair of end plates 22, 23. Each end plate has a pair of coupling slots 24, 25 for transmitting wave energy to adjoining cavities, which share a common end plate. Coupling slots 24 in one end plate 22 of cavity 20 are orthogonal to slots 25 in the other end plate 23, so there is very little direct slot-to-slot coupling. Axial holes 26 in end plates 22, 23 allow passage of the electron beam (not shown) of the TWT, which is coupled to the electric field of the cavities 20. The form and size of slots 24, 25 are such that the coupling between adjacent cavities 20 is a positive mutual inductance. Therefore, the circuit has a fundamental backward-wave transmission characteristic, as described in U.S. Pat. Nos. 3,230,413 issued Jan. 18, 1966 and 3,233,139 issued Feb. 1, 1966 to Marvin Chodorow and assigned to the assignee of the present invention. The electron beam is made to synchronize with the first forward-wave space harmonic of the circuit fields. To enhance this interaction the cavity fields are concentrated in short gaps formed by drift tubes 27 protruding from end plates 22, 23. A backward-wave circuit is particularly suited for high-frequency amplifiers because the periodic length is relatively long and the end-plate members can then be made relatively thick.

The circuit of FIG. 1 is satisfactory for microwaves of centimeter wavelengths. However, for millimeter waves there would be great difficulty in fabricating the parts, e.g., cutting holes and slots with dimensions of mils. Also, in assembly end plates 22, 23 must be brazed or bonded to rings 21, introducing undesirable electrical resistance. Furthermore, the inevitable imprecisions in the axial thicknesses of the individual plates 22 and rings 21 will be cumulative under this axial-stacking approach, impairing the regular, controlled periodicity essential to TWT performance. Still further, variations in the bond quality from joint to joint may cause variations in electrical parameters sufficient to impair the interaction characteristic of the circuit.

Figure 2A:
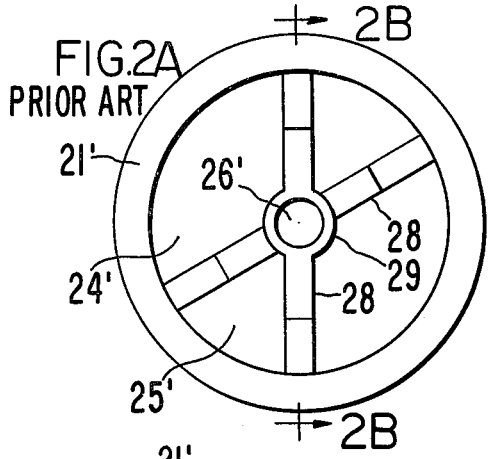
FIG.2A PRIOR ART
FIGS. 2A and 2B are schematic sectional views of a prior-art interleaved vane structure having some electrical equivalence to the circuit of FIG. 1.
Figure 2B:
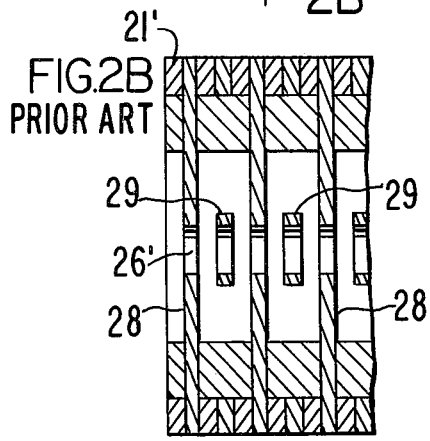
FIG.2B PRIOR ART

FIG. 2A is an axial view of another prior-art circuit having some electrical similarity to the circuit of FIG. 1. FIG. 2B is a section through the axis of FIG. 2A. The slots 24', 25' may be considered to have been enlarged to reduce the cross members of end plates 22', 23' to thin ribs 28 with a central washer-shaped enlargement 29 surrounding beam hole 26'. This circuit, obviously, is even harder to construct for millimeter wavelengths than is that of FIG. 1, and has even poorer thermomechanical and electrical loss characteristics due to the slenderness of the conducting ribs and the reliance of numerous layers to be stacked and bonded.

Figure 3A:
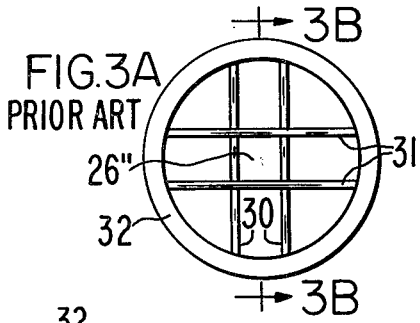
FIG.3A PRIOR ART
FIGS. 3A and 3B are schematic sectional views of a prior-art "Jungle Gym" circuit.
Figure 3B:
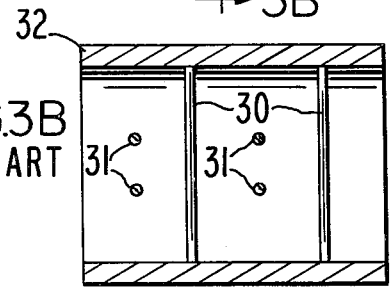
FIG.3B PRIOR ART

FIGS. 3A and 3B are an axial view and axial cross-section of a further modification of the circuit of FIG. 2, known in the literature as the "Jungle Gym". Here each conducting rib 28 has been replaced by a pair of parallel rods 30, 31 extending across a tubular envelope 32. The spaces between rods 30, 31 provide the square beam passageway 26". Since the beam is less completely surrounded by the conductors, the beam-circuit interaction is somewhat poorer than in the above-described circuits, though such comparisons may be inappropriate since the "Jungle Gym" circuit is intended for very much higher beam voltages. In any event, it is suitable only for fairly long wavelengths, such as 5 cm or more. At shorter wavelengths, most of the difficulties described in connection with FIGS. 1 and 2 are manifest. The delicateness of the thin rods is the principal obstacle to high-frequency use.

Figure 4:
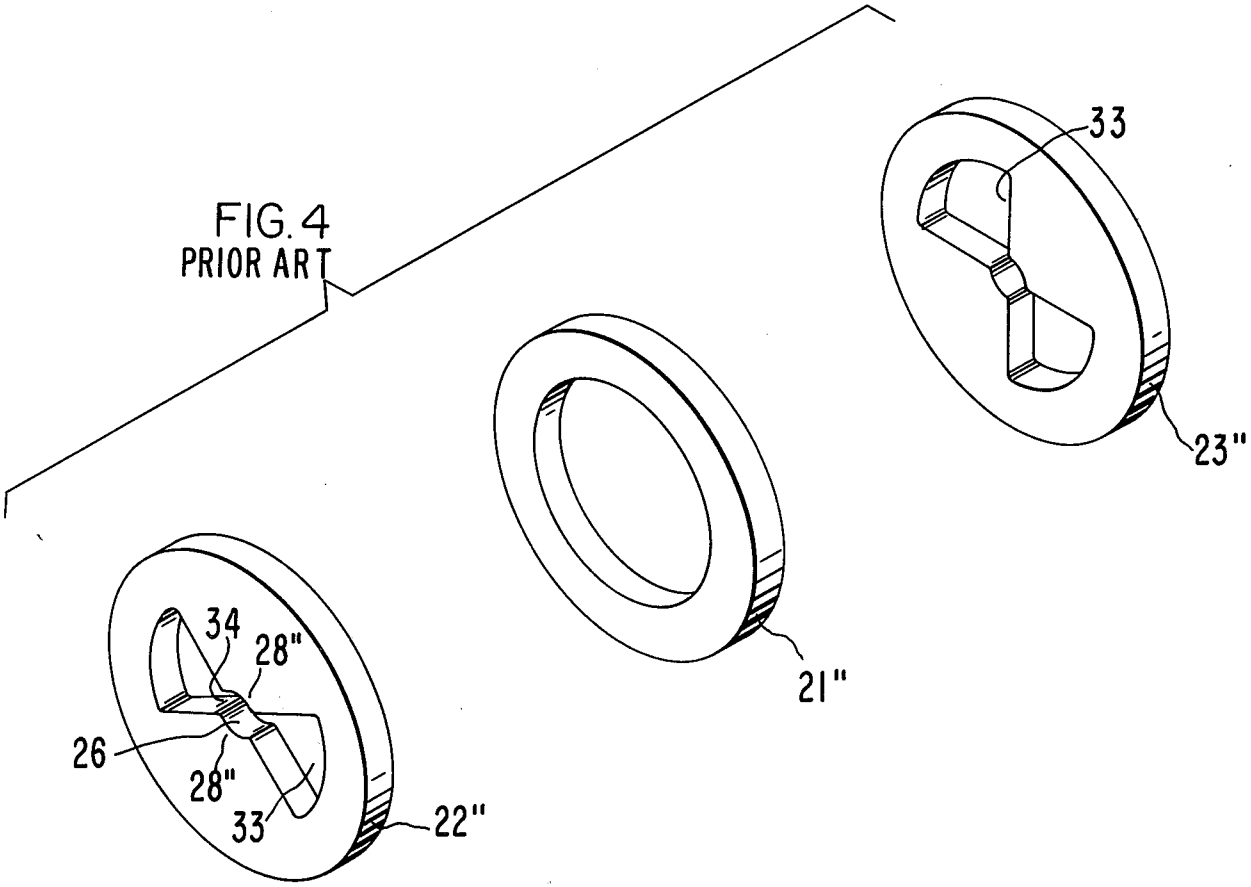
FIG. 4 PRIOR ART
FIG. 4 is an exploded view of a prior-art variation of the circuit of FIG. 1.

FIG. 4 is an exploded perspective view of a prior-art circuit somewhat akin to those of FIGS. 1 and 2. The coupling slots 24, 25 of FIGS. 1 and 2 have been converted to pie-shaped sectors 33 of end-plates 22", 23". The conducting vanes 28 of FIG. 2 have been widened to pie-shaped noses 28". In the circuit of FIG. 4 noses 28" do not join to form a washer surrounding beam-hole 26 but are separated by a gap 34. Due to the mirror-image symmetry of the structure there is no displacement current across gap 34 so the electrical properties (at least in the desired operating mode) are the same as if noses 28" were joined at their tips. For millimeter wavelengths the circuit of FIG. 4 has all the aforementioned disadvantages of the circuit of FIG. 1.

Figure 5:
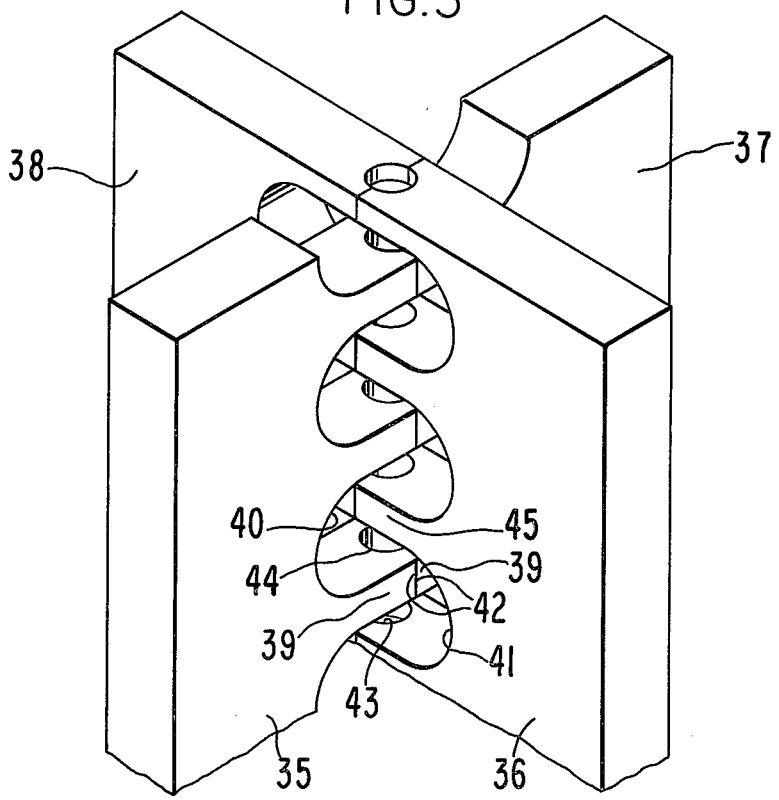
FIG. 5 is a schematic perspective view of a portion of a circuit embodying the invention.

FIG. 5 is a perspective view of an improved circuit embodying the present invention. The topological similarity to the circuit of FIGS. 2 is apparent. The construction, however, results in greatly improved performance and manufacturability. The circuit consists of four combs 35, 36, 37, 38. Each comb is preferably machined from an integral bar of high-conductivity metal such as pure copper or zirconium doped copper. Thus, there is no brazed bonded joint at any part of the circuit subject to high current, high heat flux or mechanical stress. Each comb 35, 36, 37, 38 comprises an array of parallel teeth 39 separated by grooves 40. Grooves 40 may be formed in the integral bar by a variety of processes, including milling, coining, chemical etching, electrical-discharge machining, hobbing, casting, broaching etc. In the embodiment shown, grooves 40 has rounded bottoms 41 to facilitate forming, reduce electrical losses, and improve the thermal conductivity and mechanical rigidity in the root region of the comb. However, grooves 40 may have alternative contours, such as rectangular or tapered.

The tips 42 of teeth 39 extend to a beam passageway 43. The longitudinal axis of each comb is aligned in the direction of wave propagation. In the embodiment shown, tips 42 have semicircular recesses 44 to surround beam passageway 43 and improve the beam-circuit coupling. As will be shown later, this feature is not a necessary part of the invention. Above all, an important goal achieved by fabrication of the comb from an integral piece of metal, following any of the methods listed, is precise control of the periodicity required in the TWT. The cumulative errors associated with the stacking and bonding of numerous small parts in the axial direction are avoided and the piece can be inspected against all dimensional errors prior to installation and subsequent costly assembly procedures. The requisite dimensional precision can thus be ensured along the length of an individual comb as well as among a group of combs to be assembled in registration.

A pair of combs, 35 and 37, are aligned on opposite sides of beam passageway 43 with their teeth 39 in mutual axial alignment and their tips 43 adjacent passageway 43. Thus each pair of teeth forms the electrical equivalent of a transverse bar such as 22' of FIGS. 2. Opposing tips 42 may merely touch, as shown, because there is no rf current across the mid-plane. Alternatively, they may be brazed together. There may also be a gap between them without affecting the propagation of the principal wave mode. Such a gap does introduce the possibility of other modes in which there is transverse rf voltage across the gap. The inventor believes these modes are not detrimental because they would have negligible interaction with the beam. The potential for parasitic absorptions would reside only at out-of-band frequencies. A gap between tips has the advantages of allowing individual teeth to expand thermally without any tendency to buckle, and of simplifying or eliminating the operation to provide the recesses 44.

A second pair of combs, 36 and 38 are similarly aligned on opposite sides of passageway 43. Their teeth 45 are oriented at a substantial angle such as 90 degrees to the teeth 39 of combs 35 and 37, and are interleaved with teeth 39, preferably being centered in grooves 40 so that all the gaps along beam passageway 43 are equal.

It is possible to consider the prior-art circuit of FIG. 1 alongside the present-invention circuit of FIG. 5 in the design of two TWTs having the same beam voltage and passageway size, operating frequency, bandwidth, and period between consecutive interaction gaps. When comparisons are then made, it is found that the axial thickness of teeth 39, 45 in the FIG. 5 design is substantially greater than the thickness of plate 22 in the FIG. 1 design. A significant further thermomechanical advantage of the invention is thus presented, though without sacrifice of beam-wave interaction. An indication of this interaction is a cavity parameter identified in the literature as R/Q. It is readily demonstrated that the R/Q of a cavity effectively formed between adjacent crossed tooth pairs (e.g., 39 and 45) in the FIG. 5 design is quite comparable to the R/Q of a cavity 20 of the FIG. 1 design.

Figure 6A:
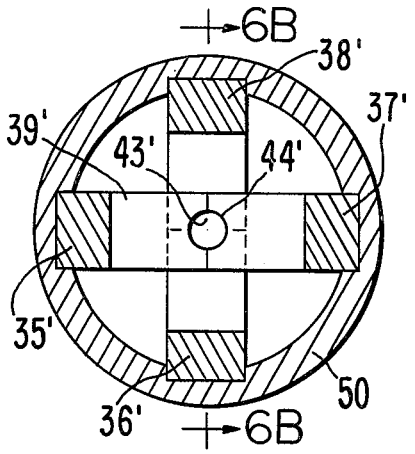
FIGS. 6A and 6B are schematic sectional views of the circuit of FIG. 5 mounted inside an envelope.
Figure 6B:
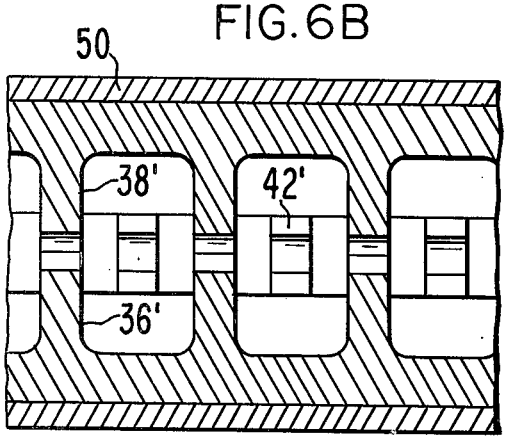

FIGS. 6A and 6B are sectional views perpendicular to the axis and through the axis, respectively, of the embodiment of the invention illustrated by FIG. 5 including an envelope 50 for supporting combs 35', 36', 37', and 38'. Envelope 50 is preferably made of metal such as copper and combs 35', 36', 37' and 38' are mounted inside it as by brazing. The brazed joints generally carry little RF current and are of large area for superior thermomechanical performance. Envelope 50 is preferably of non-magnetic material, at least in part, so that an axial magnetic field may be introduced for focussing the electron beam through passageway 43'.

Figure 7A:
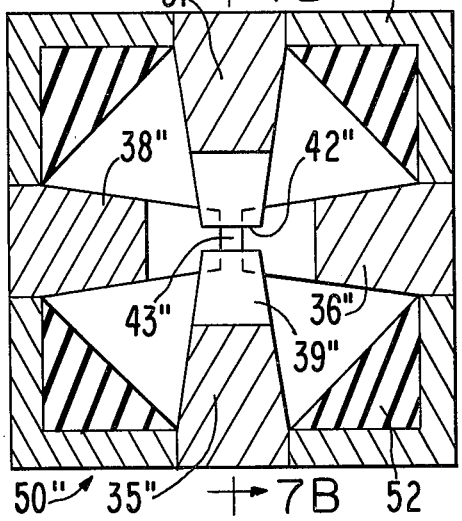
FIGS. 7A and 7B are schematic sectional views of a modification of the circuit embodying the invention.
Figure 7B:
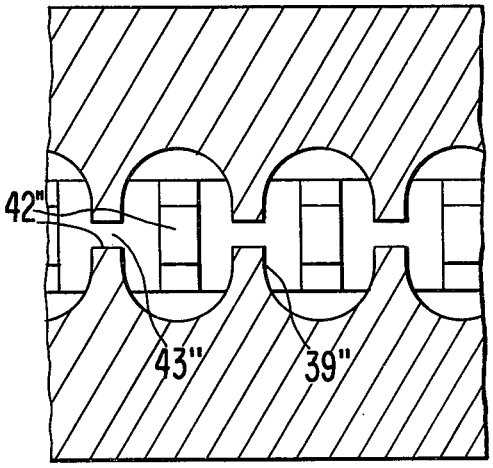

Envelope 50 need not be a complete hollow cylinder as shown in FIGS. 6 FIGS. 7A and 7B are respectively cross sections perpendicular to the axis and through the axis of an alternative embodiment in which combs 35'', 36'', 37'' and 38'' are joined by four partial envelope members 51 to form the support structure and complete the vacuum envelope 50''. In the embodiment of FIGS. 7, lossy elements 52, as of silicon carbide, are disposed in the corners of the envelope 50''. In the desired mode of operation, the rf fields fall off rapidly with distance from the comb teeth 39'', so lossy elements 52 absorb essentially none of the useful wave energy. However, out-of-band waves and spurious modes of propagation often have fields extending into the corners of the enclosure, and so can be attenuated by lossy members 52 to prevent undesired oscillations. In FIGS. 7 combs 35'', 36'', 37'' and 38'' have their transverse cross-section tapered to larger width with distance from their tips 42''. This further improves primarily the thermal conductivity and the resistance to mechanical and thermomechanical stress. Also, teeth 39'' do not surround the beam passageway 43'' but have flat ends 42'', separated to form a square passageway 43''. This makes teeth 39'' easier to fabricate, but slightly degrades the beam-circuit coupling.

Figure 8:
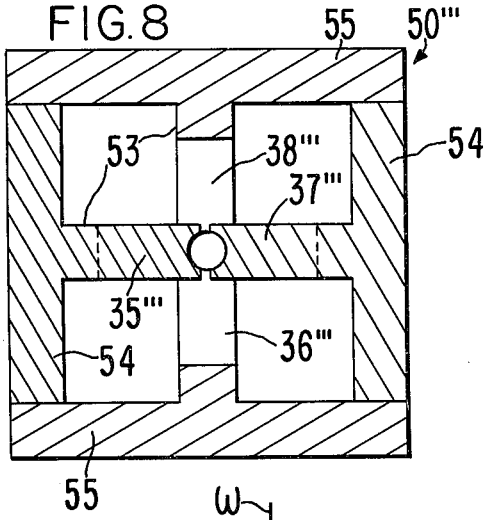
FIG. 8 is a schematic cross-section of a modification of the circuit of FIGS. 6.

FIG. 8 is a sectional view perpendicular to the axis of another alternative construction of the envelope 50'' in which the continuous back members 53 of combs 35''', 36''', 37''' and 38''' are extended laterally as longitudinal webs 54 and 55 which are joined to form envelope 50'''. The construction has fewer joints than that of FIGS. 7 so should provide less difficulty with alignment and vacuum leaks.

Figure 9:
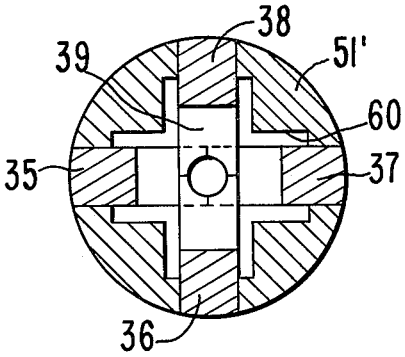
FIG. 9 is an alternative modification of the circuit of FIGS. 6.
Figure 10:
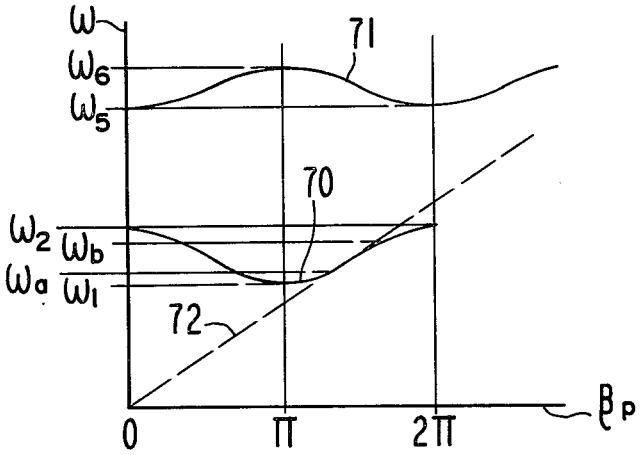
FIG. 10 is a dispersion diagram for the circuit of FIGS. 6.

FIG. 9 is a section perpendicular to the axis of an embodiment introducing an additional electrical feature. Envelope elements 51' have intrusions 60 pointing toward comb teeth 39 to produce a certain electrical effect. The effect of the intrusions 60 in FIG. 9 is electrically the same as the effect, in FIG. 1, of reducing the diameter of cavity 20 and elongating the slots 24, 25 at the same time. Such effects are best explained by the dispersion curves of FIG. 10 and FIG. 11. FIG. 10 is the familiar omega-beta diagram of a backward-wave coupled-cavity circuit such as illustrated by FIGS. 1–8. Phase shift per period $\beta p$ is plotted vs. radian frequency $\omega$, where $\beta$ is the axial wave propagation constant and p is the axial distance between successive interaction gaps. The two solid curves 70, 71 represent propagation characteristics of two distinct passbands which are commonly referred to as "modes" of propagation. The lower curve 70, a mode whose fundamental component is a backward wave, and commonly called the "cavity mode," is the one usually used in a coupled-cavity TWT because it provides higher net interaction impedance. The straight dotted line 72 represents the constant velocity of an electron beam of constant voltage. It is sufficiently synchronous to interact effectively with circuit wave 70 over a frequency range from $\omega_a$ to $\omega_b$, located between the lower and upper cutoff frequencies $\omega_1$ and $\omega_2$.

Upper curve 71 represents the foward-wave-fundamental mode commonly called the "slot mode". It provides a lower interaction impedance and is, in most prior art, regarded as an undesirable accompaniment because it can in some circumstances be excited to oscillation. Also, parasitic absorptions may possibly occur should the range $\omega_5$ to $\omega_6$ encompass the second harmonic of any frequency in the range $\omega_a$ to $\omega_6$.

Figure 11:
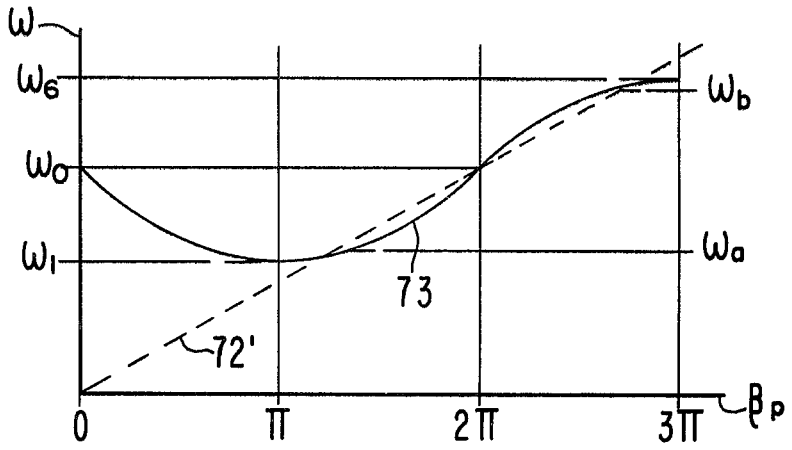
FIG. 11 is a dispersion diagram for the circuit of FIG. 9.

FIG. 11 illustrates the results of "coalescing" the two modes of FIG. 10. A similar effect is described in U.S. Pat. No. 3,668,460 issued Aug. 15, 1972, to B. G. James, W. A. Harman and J. A. Ruetz and U.S. Pat. No. 3,684,913 issued Aug. 15, 1972, to B. G. James, both assigned to the assignee of the present invention. As described therein, the low-frequency cutoff $\omega_5$ of "slot mode" 71 (FIG. 10) is reduced, by dimensioning the slots relative to the cavity diameter, to become equal to the high-frequency cut-off $\omega_2$ of "cavity mode" 70. The stop-band between modes disappears and the dispersion characteristic 73 becomes a continuous curve from lower cutoff $\omega_1$ corresponding to $\pi$ radians phase shift per cavity to upper cutoff $\omega_6$ at $3\pi$ radians phase shift. Approximate synchronism with beam velocity 72' is obtained over a greatly widened band of frequencies.

The intrusions 60 of FIG. 9 are introduced into spaces that correspond electrically to both the "cavities" and the "slots" of FIG. 1. They are dimensioned to simultaneously raise the upper cutoff frequency $\omega_2$ ("cavity resonance") of "cavity mode" 70 (FIG. 10) and lower the lower cutoff frequency $\omega_5$ of "slot mode" 71 by suitable amounts so that these frequencies become equal, thus producing a coalesced mode 73 (FIG. 11).

Figure 12:
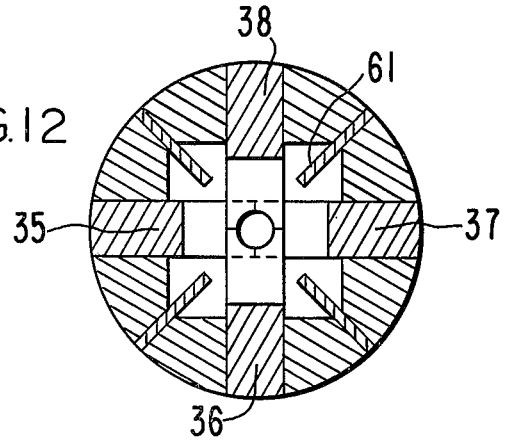
FIG. 12 is a schematic transverse section of an alternative form of the circuit of FIG. 9.

FIG. 12 illustrates an alternative construction for producing the same result as that of FIG. 9. Intrusions 60 are replaced by reentrant metallic vanes 61. Alternatively, a combination of metal and dielectric corner members, judiciously placed, may be substituted.

Figure 13:
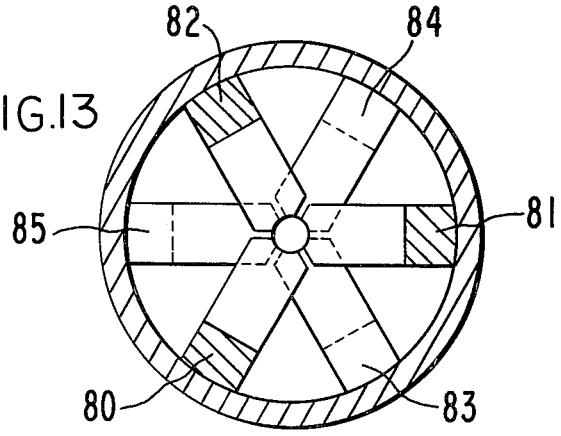
FIG. 13 is a schematic transverse sectional view of an embodiment of the invention comprising six combs.

FIG. 13 is a section perpendicular to the axis of an embodiment comprising a triplet of axially registered combs 80, 81, 82 interleaved with a similar triplet 83, 84, 85. Cavities continue to be formed between successive tooth triples, but the cavity-to-cavity coupling parameters have been altered to provide an added measure of control of the dispersion characteristic. In some circumstances, thermal capability may be enhanced. Sets of even more combs may be used within the scope of the invention. The optimum number would depend on the circumstances of application of the desired TWT.

It will be obvious to those skilled in the art that many variations may be made within the scope of my invention. The embodiments described above are intended to be illustrative and limiting. For example, the combs may not extend the entire length of the circuit but may be joined at intermediate points. Teeth of one registered comb pair may be longer than those of the orthogonal interleaved pair. Many comb and tooth profiles are possible within the concept of a comb made as an integral piece and used in groupings of replicas thereof. The tooth pitch or length may be varied intentionally along the length of the circuit to alter the wave velocity or the matching impedance or to control the interception rate. The true scope of the invention is to be defined only by the following claims and their legal equivalents.

I claim:

1. A slow-wave circuit for a traveling-wave tube comprising:

a linear passageway extending in the direction of wave propagation;

a number of integral metallic comb-shaped conducting elements with similar pitches arranged in two sets;

means for supporting said combs such that in each set the longitudinal axis of each comb extends in said direction, the teeth of each comb project toward said passageway, and tips of said teeth adjacent said passageway are registered along said direction;

the teeth of one of said sets extending in directions at substantial angles to the teeth in the other of said sets and being spaced along said passageway to align with the spaces between teeth of said other set.

2. The circuit of claim 1 wherein each of said sets is a pair of combs with teeth extending in opposite directions toward said passageway.

3. The circuit of claim 1 wherein said spaces between teeth are of greater axial extent than the axial thickness of said teeth.

4. The circuit of claim 3 wherein said teeth of said first pair are interleaved and axially spaced from the teeth of said second pair.

5. The circuit of claim 4 wherein said tips of said teeth are recessed to at least partially surround said passageway.

6. The circuit of claim 1 wherein said supporting means comprises means joining the backs of said combs to form an envelope surrounding said passageway.

7. The circuit of claim 1 wherein said registered tips of said teeth of each said set are mutually spaced.

8. The circuit of claim 1 wherein tips of teeth of a first comb of a set touch registered tips of teeth of another comb of said set.

9. The circuit of claim 1 wherein the cross section of said teeth is tapered larger with distance from the tip to increase thermal conductivity and mechanical stability.

10. The circuit of claim 6 wherein wave attenuating material is disposed within said envelope removed from said teeth of said combs.

11. The circuit of claim 6 wherein conducting material is disposed displaced from but near said teeth to cause the two principal modes of propagation to be coalesced.

12. The circuit of claim 1 wherein dielectric material is disposed near said teeth to control the electrical properties of said circuit.

13. The circuit of claim 12 wherein said dielectric material is disposed in combination with metallic material to cause the two principal modes to be coalesced.

* * * * *